US005883343A

United States Patent [19]

MacDonald et al.

[11] Patent Number: 5,883,343

[45] Date of Patent: Mar. 16, 1999

[54] DOWNPEAK GROUP OPTIMIZATION

[75] Inventors: Robert C. MacDonald, West Caldwell, N.J.; Christian Semoroz, Lucerne, Switzerland

[73] Assignee: Inventio AG, Hergiswil NW, Switzerland

[21] Appl. No.: 758,827

[22] Filed: Dec. 4, 1996

[51] Int. Cl.[6] ..... B66B 1/20

[52] U.S. Cl. ..... 187/383; 187/380

[58] Field of Search ..... 187/383, 387, 187/380

[56] References Cited

U.S. PATENT DOCUMENTS

| | | | |
|---|---|---|---|
| 4,063,620 | 12/1977 | Mandel et al. | 187/29 R |
| 4,337,847 | 7/1982 | Schroder et al. | 187/29 R |
| 4,355,705 | 10/1982 | Schröder et al. | 187/29 R |
| 4,492,288 | 1/1985 | Schroder | 187/29 R |
| 5,317,114 | 5/1994 | Pullela et al. | 187/128 |
| 5,334,807 | 8/1994 | Kupoto et al. | 187/126 |
| 5,382,761 | 1/1995 | Amano | 187/383 |
| 5,480,006 | 1/1996 | Kameli et al. . | |

FOREIGN PATENT DOCUMENTS

| | | | |
|---|---|---|---|
| 0452225 | 10/1991 | European Pat. Off. | B66B 1/20 |
| WO8101551 | 6/1981 | WIPO | B66B 1/20 |

OTHER PUBLICATIONS

European Search Report in connection with European Patent Application No. RS 98380 CH.

*Primary Examiner*—Robert E. Nappi
*Attorney, Agent, or Firm*—Greenblum & Bernstein, P.L.C.

[57] ABSTRACT

A system and method for optimally allocating elevator cars of an elevator group to serve downpeak traffic. The system monitors a "snap shot" of pending down hall calls and forms groups based upon an initialized floor separation value or response range. If the number of groups formed is greater than the number of available elevator cars in the elevator group, the system increments the floor separation value by "+1" and regroups the "snap-shot" of pending down hall calls. This procedure may be repeated until the number of formed groups is equal to or less than the number of allocable elevator cars. The system may then allocate each formed group to a respective available elevator car to serve the downpeak traffic.

27 Claims, 4 Drawing Sheets

| | |
|---|---|
| 1 | E15 |
| 1 | E14 |
| 1 | E13 |
| 0 | E12 |
| 1 | E11 |
| 1 | E10 |
| 1 | E9 |
| 0 | E8 |
| 1 | E7 |
| 0 | E6 |
| 0 | E5 |
| 0 | E4 |
| 0 | E3 |
| 0 | E2 |
| 0 | E1 |

Floor Separation = 1

Group Size = 5

Number of Formed Group = 5

Floor Separation = 2

Group Size = 5

Number of Formed Group = 3

DOWNPEAK GROUP OPTIMIZATION

BACKGROUND OF THE INVENTION

1. Field of the Invention

The present invention is directed to a system for optimizing the allocation of downpeak elevator traffic in an elevator group.

2. Discussion of the Background Information

During evening rush hours, heavy elevator traffic occurs in which the elevators cars generally fill up at the upper floors and bypass the lowers floors. Thus, down floor call waiting times in the lower floors rise dramatically.

To equalize service among the upper and lower floors, some elevator control systems utilize a computer controlled dispatch strategy to allocate elevator traffic according to a time based algorithm. One example of such a time based algorithm strategy is shown in U.S. Pat. No. 4,492,288, the disclosure of which is incorporated by reference in its entirety. In the '288 patent, down hall calls are combined to form groups based upon a somewhat chronological order of inputted hall calls. The down hall calls are stored in a RAM in chronological order. The oldest call is allocated to a highest priority elevator car and the next oldest call is allocated to either the highest priority elevator car or to a second priority car, depending upon the specific situation.

Another system for allocating down hall calls is shown in U.S. Pat. No. 5,480,006. During a downpeak period, this system gives priority service to down travelling traffic and reserves at least one elevator car for up service. However, all floors requiring down service are given equal access to the system regardless of the floor position in relation to the building. The system divides the building into a number of sectors equal to the number of cars available for downpeak. Any remaining floors are redistributed to the lower. A particular sector is assigned to a car depending upon the age of the sector. Once the sector is assigned, the car parks at the top of the sector until a down hall call is made and serves the down hall calls from highest to lowest.

However, even utilizing the above noted strategies, high average waiting times still exist due to the corresponding poor distribution of elevators throughout the building.

SUMMARY OF THE INVENTION

It is an object of the present invention to provide a downpeak group optimization system that does not suffer from the above-noted drawbacks of the prior art.

Accordingly, the present invention may be directed to a group optimization system for use in a multiple car elevator group to allocate each car in the elevator group to serve a predefined demand within a group serving a predetermined number of floors. The group optimization system may include a device for specifying allocable cars for serving the predefined demand that includes a device for determining a number of cars specified and a device for initializing a response range for the elevator group. The response range may include a predetermined number of adjacent floors. The group optimization system may also include a device for storing hall call requests, a device for scanning the storing means to determine specific floors requesting elevator service, and a device for grouping the specific floors requesting service, in an order from an uppermost floor to a lowermost floor. The grouping device may form non-overlapping groups of a size less than or equal to the response range. The system may also include a device for comparing a number of the non-overlapping groups formed by the grouping means with the specified number of allocable cars and a device for allocating a unique one of the non-overlapping groups to each of the allocable cars.

In accordance with another feature of the present invention, the number of non-overlapping groups may be equal to the number of specified allocable cars. Alternatively, the number of non-overlapping groups may be greater than the number of specified allocable cars.

In accordance with a still further feature of the present invention, the comparing device may include a device for incrementing the response range by one floor when the number of non-overlapping groups is greater than the number of specified allocable cars. The system may also include a device for regrouping the specific floors requesting service, in an order from an uppermost floor to a lowermost floor. The regrouping device may form non-overlapping regrouped groups of a size less than or equal to the incremented response range. The system may also include a device for comparing a number of the non-overlapping regrouped groups with the number of specified allocable cars and the allocating device may also allocate a unique one of the non-overlapping regrouped groups to each of the allocable cars when the number of non-overlapping groups is one of equal to or less than the number of specified allocable cars.

In accordance with a further feature of the present invention, the comparing device may include a device for incrementing the response range by one floor when the number of non-overlapping regrouped groups is greater than the number of specified allocable cars and the system may repeat the steps of regrouping the specific floors requesting service, comparing the number of regrouped group, and incrementing the response range until the number of the non-overlapping regrouped groups is equal to or less than the number of specified allocable cars.

In accordance with still another feature of the present invention, the system may be enabled by initiation of a downpeak period.

In accordance with yet another feature of the present invention, a specified time period after the allocable cars are allocated, the scanning device may rescan the storing device to determine specific floors requesting service.

In accordance with another feature of the present invention, the grouping device grouping the specific floors requesting service, in an order from an uppermost floor to a lowermost floor, the grouping means forming non-overlapping groups of a size equal to the response range for each group above a lowest formed group and of a size less than or equal to the response range for the lowest formed group.

The present invention may be directed to a method for optimizing elevator car allocation in a multiple car elevator group to allocate each car in the elevator group to serve a predefined demand. The elevator group may serve a predetermined number of floors. The group optimization method may include specifying allocable cars for serving the predefined demand and for determining a number of cars specified and initializing a response range for the elevator group, the response range including a predetermined number of adjacent floors. The method may also include scanning for pending hall calls to determine specific floors requesting elevator service, grouping the specific floors requesting service, in an order from an uppermost floor to a lowermost floor and forming non-overlapping groups of a size less than or equal to the response range, and comparing a number of the non-overlapping groups formed by the grouping means with the specified number of allocable cars. The method may also include allocating a unique one of the non-overlapping groups to each of the allocable cars.

In accordance with another feature of the present invention, the number of non-overlapping groups may be equal to the number of specified allocable cars.

In accordance with still another feature of the present invention, the number of non-overlapping groups may be greater than the number of specified allocable cars.

In accordance with yet another feature of the present invention, the method may include incrementing the response range by one floor when the number of non-overlapping groups is greater than the number of specified allocable cars.

In accordance with a further feature of the present invention, the method may include regrouping the specific floors requesting service, in an order from an uppermost floor to a lowermost floor and forming non-overlapping regrouped groups of a size equal to the incremented response range and of a size less than or equal to the incremented response range for a lowest formed group, and comparing a number of the non-overlapping regrouped groups with the number of specified allocable cars. The method may also include allocating a unique one of the non-overlapping regrouped groups to each of the allocable cars when the number of non-overlapping groups is one of equal to or less than the number of specified allocable cars.

According to a still further feature of the present invention, the method may include incrementing the response range by one floor when the number of non-overlapping regrouped groups is greater than the number of specified allocable cars. The method may also include repeating the steps of regrouping the specific floors requesting service, comparing the number of regrouped group, and incrementing the response range until the number of the non-overlapping regrouped groups is equal to or less than the number of specified allocable cars.

In accordance with still another feature of the present invention, the method may be enabled the method by initiating a downpeak period.

In accordance with yet another feature of the present invention, a specified time period after the allocable cars are allocated, the method may include rescanning the pending hall calls to determine specific floors requesting elevator service.

In accordance with yet another feature of the present invention, the method may include grouping the specific floors requesting service, in an order from an uppermost floor to a lowermost floor and forming non-overlapping groups of a size equal to the response range for each group above a lowest formed group and of a size less than or equal to the response range for the lowest formed group.

The present invention is directed to a group optimization system for use in a multiple car elevator group to allocate each car in the elevator group to serve a predefined demand. The elevator group serves a predetermined number of floors. The group optimization system includes a specifying device that specifies allocable cars for serving the predefined demand and that includes a device that determines a number of cars specified by the specifying device. The system also includes an initializer that initializes a response range for the elevator group that includes a predetermined number of adjacent floors, a scanner that scans pending hall calls to determine specific floors requesting elevator service, and a grouping device that groups the specific floors requesting service, in an order from an uppermost floor to a lowermost floor. The grouping device forms non-overlapping groups of a size less than or equal to the response range. The system further includes a compare that compares a number of the non-overlapping groups formed by the grouping device with the specified number of allocable cars, and an allocator that allocates a unique one of the non-overlapping groups to each of the allocable cars.

In accordance with another feature of the present invention, the number of non-overlapping groups is equal to the number of specified allocable cars.

In accordance with another feature of the present invention, the number of non-overlapping groups is greater than the number of specified allocable cars.

In accordance with still another feature of the present invention, the compare includes an incrementer that increments the response range by one floor when the number of non-overlapping groups is greater than the number of specified allocable cars. Further, the system includes a regrouping device that regroups the specific floors requesting service, in an order from an uppermost floor to a lowermost floor. The regrouping device forms non-overlapping regrouped groups of a size equal to the incremented response range and of a size less than or equal to the incremented response range for a lowest formed group. The system also includes a comparing device that compares a number of the non-overlapping regrouped groups with the number of specified allocable cars, and the allocator being adapted to allocate a unique one of the non-overlapping regrouped groups to each of the allocable cars when the number of non-overlapping groups is one of equal to or less than the number of specified allocable cars. Further still, the comparing device includes an incrementing device that increments the response range by one floor when the number of non-overlapping regrouped groups is greater than the number of specified allocable cars, and the regrouping device, the comparing device, and the incrementing device are repeatedly and sequentially actuated until the number of the non-overlapping regrouped groups is equal to or less than the number of specified allocable cars.

In accordance with another feature of the present invention, the system is enabled by initiation of a downpeak period.

In accordance with another feature of the present invention, a specified time period after the allocable cars are allocated, the scanner is adapted to rescan the pending hall calls to determine specific floors requesting elevator service.

In accordance with another feature of the present invention, the grouping device is adapted to group the specific floors requesting service, in an order from an uppermost floor to a lowermost floor, and the grouping device forms non-overlapping groups of a size equal to the response range for each group above a lowest formed group and of a size less than or equal to said response range for the lowest formed group.

The above-noted objects and features of the present invention will be more specifically discussed below with reference to the appended drawing figures and to specific examples.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
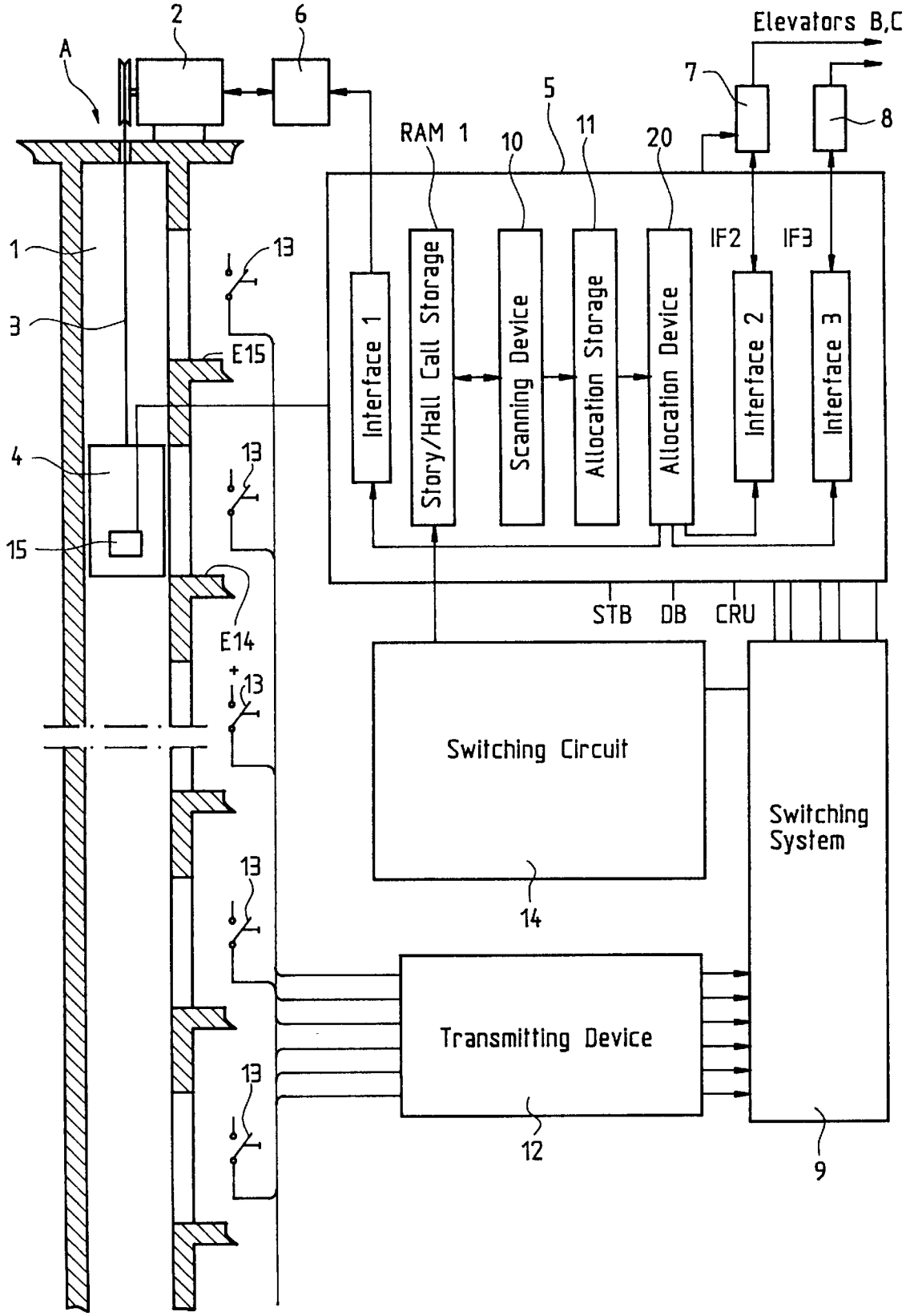
FIG. 1 is a schematic illustration of the group control system for use with the present invention.

An elevator control system for optimizing the downpeak traffic according to the present invention is generally shown in FIG. 1 and is similar to the system disclosed in U.S. Pat. No. 4,492,288, the disclosure of which is incorporated by reference herein in its entirety. An elevator shaft 1 for an elevator A of an elevator group including, for example, three elevators, shown as A, B, and C. An elevator car 4 is guided in the elevator shaft 1 and is driven by any suitable hoisting or drive engine 2 by a hoisting cable 3 or other similar hoisting device. In the exemplary elevator system shown in FIG. 1, the building may include, e.g., fifteen stories E1–E15 for service. The hoisting or drive engine 2 may be controlled by a drive control, e.g., as shown in U.S. Pat. No. 4,337,847, the disclosure of which is incorporated by reference herein in its entirety. The drive control may include a microcomputer system 5 for realizing reference value generation, the automatic regulation or control functions and stop initiation, and further may include measuring and adjusting members 6 of such drive control which are connected to the microcomputer system 5 through a first interface IF1. The microcomputer systems 5 of the individual elevators A, B, and C are interconnected by a comparator 7 and a second interface IF2 and via a party line transmitting system 8 and a third interface IF3. In this manner, the microcomputer system 5 forms a group control, e.g., as shown in U.S. Pat. No. 4,335,705. Through the group control, elevators A, B, and C may be optimally allocated to respond to story or hall calls stored in a story/hall call storage RAM1. Microcomputer system 5 may also include a scanning device 10 that scans RAM1 to detect which floors have outstanding story/hall calls and stores the floor locations in an allocation storage memory 11. Scanning device 10 may be implemented with a software function stored in a programmable read only memory, e.g., an EPROM, and allocation storage memory 11 may be implemented with any conventional memory device including, e.g., a random access memory (RAM).

Scanning device 10 may be enabled when the elevator system enters the downpeak period, e.g., at 4:30 pm. The time may be monitored by an internal clock, not shown. To avoid problems with unreasonable waiting times for passengers, the scanning device, takes an initial scan of RAM1 and stores the current story/hall calls in allocation storage memory 11. After the scan, RAM1 is cleared and filled with the next series of story/hall calls. However, scanning device 10 may await an enable signal from an allocation device 20, which may be implemented by a periodic timer or other suitable device. That is, after allocation device 20 has allocated the story/hall calls stored in the allocation storage memory 11 to the available elevator cars for servicing the downpeak traffic, allocation device 20 may signal the scanning device to forward the next set of awaiting story/hall calls.

A switching system or arrangement 9 may be utilized to supply the story/hall calls to the microcomputer system 5. During the downpeak period, an input side switching system 9 may be connected to descent or down-hill call transmitters 13 by means of a transmitting device 12 which transmits the descent or down hall calls in the timewise sequence or chronological order of their input. The chronological input of down hall calls are transmitted to a switching circuit 14 through switching system 9. Switching circuit 14 may be coupled to RAM1 to indicate a logical "high" or logic "1" for each pending hall call. As shown, RAM1 may include an entry for each floor of the building, e.g., fifteen. The RAM1 may then be filled with a sequence of 1s and 0s indicating passengers awaiting service on a specified floor. For the example shown in FIG. 1, RAM1 includes down hall calls for floors E15, E13, and E5.

The general operation of the transmission and storage of down hall calls during the downpeak period may be as described in the following manner:

After switching to a downpeak period, transmitting device 12 chronologically forwards the floor locations for each actuation of descent or down hall call transmitters 13. For example, assume that upon actuation of downpeak the chronological input order of down hall calls is E14, followed by E13, and then E15. Each down hall call is forwarded to switching circuit 14 through switching system 9. Switching circuit 14 forwards each floor location to story/hall call storage RAM1, to be stored until scanning device 10 is enabled.

After the scanning device has scanned story/hall call storage RAM1 and stored the pending down hall call locations, e.g., E14, E13, E15 in allocation storage memory 11, a program, e.g., stored within allocation device 20, for optimizing the allocation elevator cars to respond to the downpeak traffic, i.e., a downpeak optimization system, may be utilized.

Figure 2:
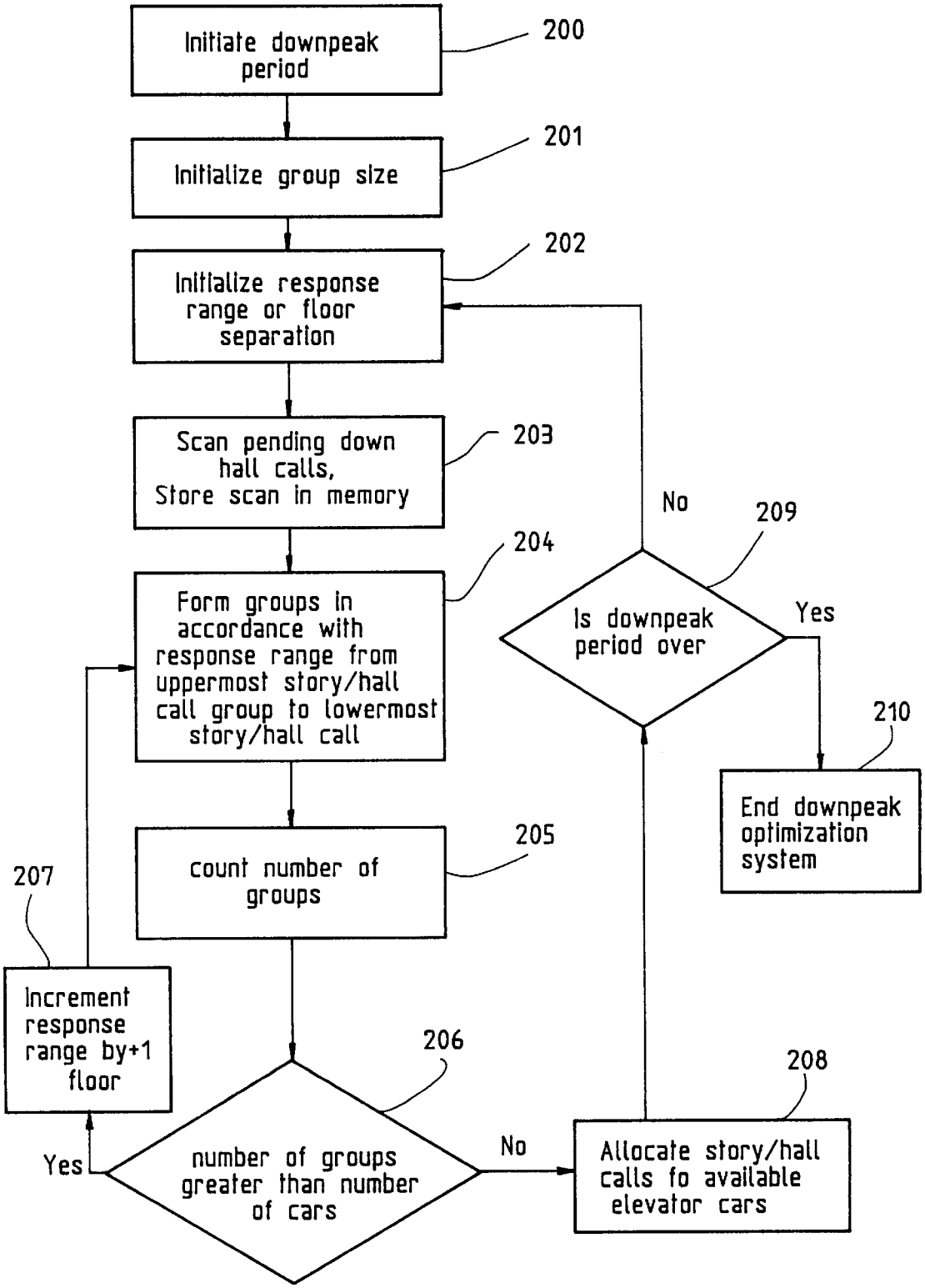
FIG. 2 illustrates an flow diagram of an exemplary downpeak optimization system in accordance with the present invention.

FIG. 2 shows an exemplary flow diagram of the downpeak optimization system in accordance with the present invention. The flow diagram begins with the initiation of the downpeak period. As noted above, the downpeak period is generally an evening rush time and may begin, e.g., at 4:30 pm. The time of day may be monitored by an internal clock, or similar device, not shown.

At step 201, the downpeak optimization system may initialize a group size for the elevator group. The group size may be a predetermined number of floors that any particular elevator group may properly respond to. Assuming that the group size is set to be 5 floors, then each downpeak group may only respond to three floor calls per cycle.

The group size may be determined by considering the number of cars that may be allocated to respond to the downpeak traffic and the number of stories or floors in the building. For example, assuming that the present invention is used in a fifteen story building and that the system utilizes three elevator cars for responding to downpeak traffic, then the group size may be determined by dividing the total number of floors by the allocable elevator cars. In this particular example, the group size may be five. Thus, the largest group that may be allocated to an individual elevator car is a group including five floors.

Once the group size is established, step 202 initializes a floor separation (response range) value to initially specify the floor separation (or range) between the first and last call allocable to each group. In other words, when the floor separation value is initially specified as "1", the range of calls between the first and last allocated call is "1" floor, or two adjacent floors. The range of calls for the elevator group may be thought of as including an uppermost down hall call floor and a number of floors below the first call floor equal to the specific floor separation value. Thus, when the floor separation value is initiated as, e.g., "1", each group may not be greater two adjacent floors. For example, if a highest story/hall call originates from floor E10, then the range of calls allocable to the first group is from floors E10 and E9. Any story/hall calls originating below floor E9 must be allocated to a subsequently established group.

After initializing the floor separation value, the building may be scanned in step 203 for outstanding or pending down story/hall calls. As discussed above, the scanning may be performed by a scanning device 10 scanning the values chronologically input into story/hall call storage RAM1. The scanned values may then be stored in an allocation storage memory 11. However, unlike prior art systems, the present system does not require storing story/hall calls in chronological order, the allocation storage memory 11 contains a "snap-shot" of the scanned story/hall call storage RAM1. Thus, the allocation storage memory 11 indicates whether a down call has been issued from a particular floor and which floors require downpeak allocation by the downpeak optimization system.

Figures 3, 4:
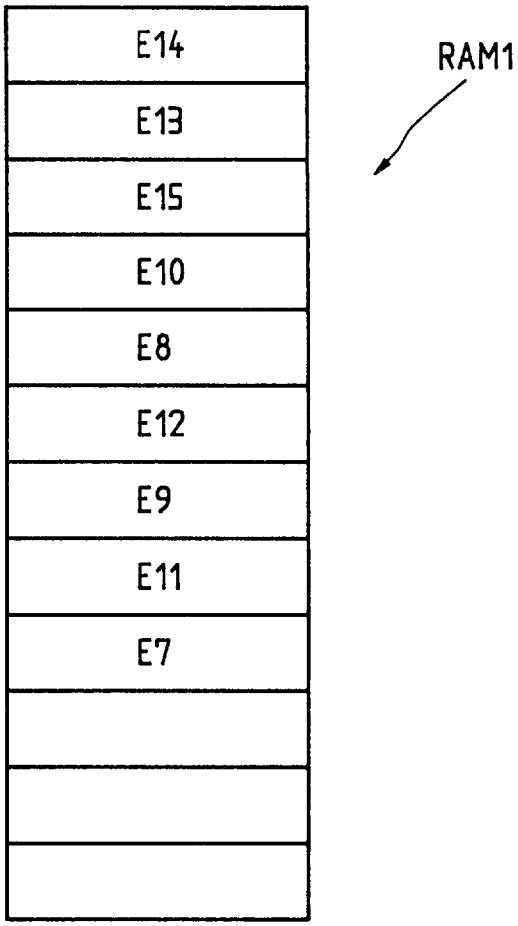
FIG. 3 illustrates an example of a story/hall call storage RAM1.
FIG. 4 illustrates an example of an allocation storage.

Assume that, as shown in FIG. 3, prior to scanning the building, down story/hall calls were made from the following floors in the order of, e.g., E14, E13, E15, E10, E8, E12, E9, E11, and E7. FIG. 3 represents an example of story/hall call storage RAM1 with the calls stored in chronological order. FIG. 4 represents an example of allocation storage memory 11 after scanning device 10 has scanned story/hall call storage RAM1. Allocation storage memory 11 indicates, by logic "1", which floors have outstanding down calls and/or which floors require response by an allocable downpeak elevator car. As shown in FIG. 4, allocation storage 11 may simply indicate which floors have requested down service, i.e., floors E15, E14, E13, Ell, E10, E9, and E7.

Figure 5:
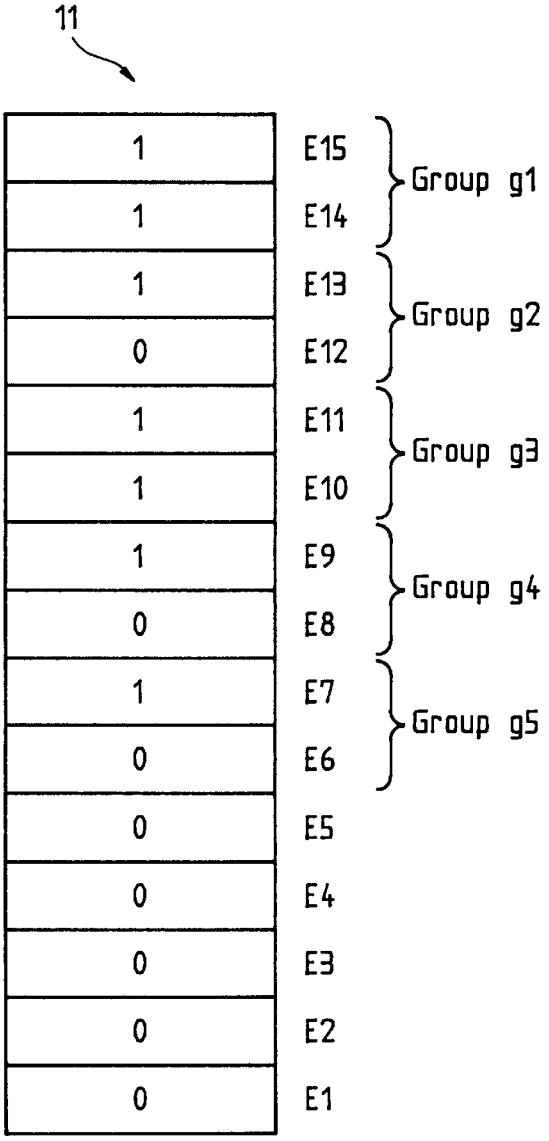
FIG. 5 illustrates an example of an initial grouping of calls by the downpeak group optimization system of the present invention.

After the outstanding down story/hall calls have been scanned and stored, the downpeak optimization system, in step 204, determines a number of groups necessary to service the downpeak load. Thus, as shown in FIG. 4, down hall calls have been issued (down service has been requested from) each of floors E15–E13, E11–E9, and E7. In accordance with the grouping procedure of the present invention, the system may determine the number of groups beginning with, e.g., the top-most story/hall call floor E15, to start grouping. FIG. 5 shows an example of a first grouping by the downpeak optimization system. Group g1 may be initially include the call from uppermost down hall call, e.g., E15, and a specified number of adjacent floors below the uppermost call equal to the floor separation or response range, e.g., the initialized value "1". Accordingly, group g1 may initially include E15 and E14. Group g2 may include the next down story/hall call stored in the story/hall call storage not within group g1, e.g., E13. Group g2 may solely include E13, because the only other floor available to be included in group g2, as determined by the initial floor separation value of "1", would only include E12. However, according to the building scan, down service was not requested through the story/hall call at E12, group g2 includes only one down call member. Group g3 may include the next stored story/hall call, e.g., E11, and also E10. Group g4 may include E9. Group g5 may include E7.

It is noted that each group must include at least one story/hall call. It is also noted that it is not necessary that each floor be included in the grouping scheme. However, the grouping should not include overlapping group members, i.e., each group is formed in a non-overlapping fashion.

After the groups are initially established, the number of established groups may compared, in step 205, with the total number of elevator cars available to serve the downpeak load. Assuming that the system has been designated with three elevator cars available to service the downpeak load, the three elevators cannot adequately handle five groups formed in the initial grouping of the down hall calls.

Figure 6:
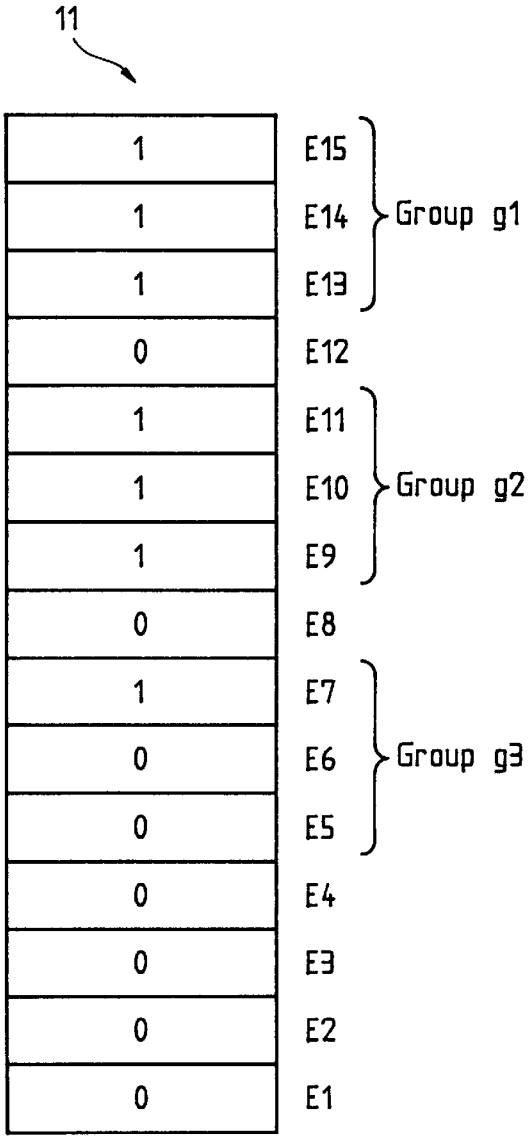
FIG. 6 illustrates an example of a incremented grouping of calls by the downpeak group optimation system of the present invention.

When the system initially establishes a number of groups that is greater than the total number of elevator cars available to serve the groups, then, in step 207, the downpeak optimization system may increment the floor separation value by a value of "+1" such that the floor separation value may now be "2". Thus, each group may now include, e.g., three adjacent floors. The flow diagram returns to step 204 to form groups in accordance with the new floor separation or response range. Thus, after incrementing the response range, FIG. 6 shows an example of the grouping performed by the downpeak optimization system according to the present invention. From the uppermost down story/hall call to the lowermost down story/hall call, the grouping of the calls stored in allocation storage 11 may be as follows: group g1 may include E15, E14, and E13; group g2 may include E11, E10, and E9; and group g3 may include E7. In step 205, the downpeak optimization system may count that three groups have been formed. In step 206, the system may now determine that the number of established groups is equal to the number of available elevator cars. Thus, in step 208, the system may now allocate the floor locations to the appropriate elevator cars to service the downpeak load.

After the elevator cars have been allocated to respond to the downpeak demand, the downpeak optimization system may return to step 202 to initialize the floor separation or response range to "1" and to repeat steps 203–208. The procedure may cycle through the flow diagram steps allocating downpeak demand to the available elevator cars until a predefined downpeak termination time, e.g., 8:00 pm.

According to the present invention, the building is scanned one time and a "snap shot" of the down story/hall calls currently pending is stored and utilized for the grouping-increment-grouping steps. Once the down story/hall calls are allocated to the available elevator cars, the "snap shot" is voided or cleared, and the system repeats from the initialization of the response range. Further, it is noted that if the number of groups formed is less than the number of cars available for allocation, the system will allocate the car with the most advantageous response route to the respective unique groups of down calls.

As can be seen from the above example, the downpeak system according to the present invention optimizes the use of the available elevator cars to lessen the total number of floors traveled by the available elevator cars. Further, the present invention is not limited by the total number of floors or the available elevator cars. The present invention takes each of those factors into account as a variable prior to determining the optimum downpeak assignment of down story/hall calls to the available elevator cars.

An additional advantage of the present invention is that the present system may be utilized in zonal elevator systems, i.e., where certain cars are dedicated to specified zones or floors of a building. Thus, the routine discussed above may optionally be utilized in each predefined building zone to optimize the downpeak traffic per zone.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A group optimization system for use in a multiple car elevator group to allocate each car in the elevator group to serve a predefined demand, said elevator group serving a predetermined number of floors said group optimization system comprising:

means for specifying allocable cars for serving the predefined demand, said specifying means including means for determining a number of cars specified by said specifying means;

means for initializing a response range for said elevator group, said response range including a predetermined number of adjacent floors;

means for scanning pending hall calls to determine specific floors requesting elevator service;

means for grouping said specific floors requesting service, in an order from an uppermost floor to a lowermost floor, said grouping means forming non-overlapping groups of a size less than or equal to said response range;

means for comparing a number of said non-overlapping groups formed by said grouping means with said specified number of allocable cars;

means for allocating a unique one of said non-overlapping groups to each of said allocable cars.

2. The group optimization system according to claim 1, wherein said number of non-overlapping groups is equal to said number of specified allocable cars.

3. The group optimization system according to claim 1, wherein said number of non-overlapping groups is greater than said number of specified allocable cars.

4. The group optimization system according to claim 1, said comparing means including means for incrementing said response range by one floor when said number of non-overlapping groups is greater than said number of specified allocable cars.

5. The group optimization system according to claim 4, further comprising:

means for regrouping said specific floors requesting service, in an order from an uppermost floor to a lowermost floor, said regrouping means forming non-overlapping regrouped groups of a size equal to said incremented response range and of a size less than or equal to said incremented response range for a lowest formed group;

means for comparing a number of said non-overlapping regrouped groups with said number of specified allocable cars;

said allocating means further for allocating a unique one of said non-overlapping regrouped groups to each of said allocable cars when said number of non-overlapping groups is one of equal to or less than said number of specified allocable cars.

6. The group optimization system according to claim 5, said comparing means including means for incrementing said response range by one floor when said number of non-overlapping regrouped groups is greater than said number of specified allocable cars; and said system adapted to repeatedly actuate said regrouping means to regroup said specific floors requesting service, said comparing means to compare said number of regrouped group, and said incrementing means to increment said response range until said number of said non-overlapping regrouped groups is equal to or less than said number of specified allocable cars.

7. The group optimization system according to claim 1, said system enabled by initiation of a downpeak period.

8. The group optimization system according to claim 1, wherein a specified time period after said allocable cars are allocated, said scanning means further for rescanning said pending hall calls to determine specific floors requesting elevator service.

9. The group optimization system according to claim 1, said means for grouping said specific floors requesting service, in an order from an uppermost floor to a lowermost floor, said grouping means forming non-overlapping groups of a size equal to said response range for each group above a lowest formed group and of a size less than or equal to said response range for said lowest formed group.

10. A method for optimizing elevator car allocation in a multiple car elevator group to allocate each car in the elevator group to serve a predefined demand, the elevator group serving a predetermined number of floors the group optimization method comprising:

specifying allocable cars for serving the predefined demand and for determining a number of cars specified;

initializing a response range for the elevator group, the response range including a predetermined number of adjacent floors;

scanning for pending hall calls to determine specific floors requesting elevator service;

grouping the specific floors requesting service, in an order from an uppermost floor to a lowermost floor and forming non-overlapping groups of a size less than or equal to the response range;

comparing a number of the non-overlapping groups formed by the grouping means with the specified number of allocable cars; and allocating a unique one of the non-overlapping groups to each of the allocable cars.

11. The group optimization method according to claim 10, wherein the number of non-overlapping groups is equal to the number of specified allocable cars.

12. The group optimization method according to claim 10, wherein the number of non-overlapping groups is greater than the number of specified allocable cars.

13. The group optimization method according to claim 10, incrementing the response range by one floor when the number of non-overlapping groups is greater than the number of specified allocable cars.

14. The group optimization method according to claim 13, further comprising:

regrouping the specific floors requesting service, in an order from an uppermost floor to a lowermost floor and forming non-overlapping regrouped groups of a size equal to the incremented response range and of a size less than or equal to the incremented response range for a lowest formed group;

comparing a number of the non-overlapping regrouped groups with the number of specified allocable cars; and allocating a unique one of the non-overlapping regrouped groups to each of the allocable cars when the number of non-overlapping groups is one of equal to or less than the number of specified allocable cars.

15. The group optimization method according to claim 14, incrementing the response range by one floor when the number of non-overlapping regrouped groups is greater than the number of specified allocable cars; and the method repeating the regrouping of the specific floors requesting service, the comparing of the number of regrouped groups, and the incrementing of the response range until the number of the non-overlapping regrouped groups is equal to or less than the number of specified allocable cars.

16. The group optimization method according to claim 10, further comprising:

establishing a downpeak period; and actuating the group optimization method upon initiation of the downpeak period.

17. The group optimization method according to claim 10, wherein a specified time period after the allocable cars are allocated, rescanning the pending hall calls to determine specific floors requesting elevator service.

18. The group optimization method according to claim 10, grouping the specific floors requesting service, in an order from an uppermost floor to a lowermost floor and forming non-overlapping groups of a size equal to the response range for each group above a lowest formed group and of a size less than or equal to the response range for the lowest formed group.

19. A group optimization system for use in a multiple car elevator group to allocate each car in the elevator group to serve a predefined demand, said elevator group serving a predetermined number of floors said group optimization system comprising:

a specifying device that specifies allocable cars for serving the predefined demand, said specifying device including a device that determines a number of cars specified by said specifying device;

an initializer that initializes a response range for said elevator group, said response range including a predetermined number of adjacent floors;

a scanner that scans pending hall calls to determine specific floors requesting elevator service;

a grouping device that groups said specific floors requesting service, in an order from an uppermost floor to a lowermost floor, said grouping device forming non-overlapping groups of a size less than or equal to said response range;

a compare that compares a number of said non-overlapping groups formed by said grouping device with said specified number of allocable cars; and an allocator that allocates a unique one of said non-overlapping groups to each of said allocable cars.

20. The group optimization system according to claim 19, wherein said number of non-overlapping groups is equal to said number of specified allocable cars.

21. The group optimization system according to claim 19, wherein said number of non-overlapping groups is greater than said number of specified allocable cars.

22. The group optimization system according to claim 19, said compare including an incremented that increments said response range by one floor when said number of non-overlapping groups is greater than said number of specified allocable cars.

23. The group optimization system according to claim 22, further comprising:

a regrouping device that regroups said specific floors requesting service, in an order from an uppermost floor to a lowermost floor, said regrouping device forming non-overlapping regrouped groups of a size equal to said incremented response range and of a size less than or equal to said incremented response range for a lowest formed group;

a comparing device that compares a number of said non-overlapping regrouped groups with said number of specified allocable cars; and said allocator being adapted to allocate a unique one of said non-overlapping regrouped groups to each of said allocable cars when said number of non-overlapping groups is one of equal to or less than said number of specified allocable cars.

24. The group optimization system according to claim 23, said comparing device including an incrementing device that increments said response range by one floor when said number of non-overlapping regrouped groups is greater than said number of specified allocable cars; and said regrouping device, said comparing device, and said incrementing device being repeatedly and sequentially actuated until said number of said non-overlapping regrouped groups is equal to or less than said number of specified allocable cars.

25. The group optimization system according to claim 19, said system being enabled by initiation of a downpeak period.

26. The group optimization system according to claim 19, wherein a specified time period after said allocable cars are allocated, said scanner is adapted to rescan said pending hall calls to determine specific floors requesting elevator service.

27. The group optimization system according to claim 19, said grouping device being adapted to group said specific floors requesting service, in an order from an uppermost floor to a lowermost floor; and said grouping device forming non-overlapping groups of a size equal to said response range for each group above a lowest formed group and of a size less than or equal to said response range for said lowest formed group.

* * * * *